US011225397B2

(12) United States Patent
Schulz

(10) Patent No.: US 11,225,397 B2
(45) Date of Patent: Jan. 18, 2022

(54) SAFETY DEVICE FOR A LIFT SYSTEM, LIFT SYSTEM AND METHOD FOR OPERATING A SAFETY DEVICE

(71) Applicant: TK Elevator Innovation and Operations GmbH, Duesseldorf (DE)

(72) Inventor: Christian Schulz, Stuttgart (DE)

(73) Assignee: TK Elevator Innovation and Operations GmbH, Duesseldorf (DE)

( * ) Notice: Subject to any disclaimer, the term of this patent is extended or adjusted under 35 U.S.C. 154(b) by 0 days.

(21) Appl. No.: 16/612,078

(22) PCT Filed: May 8, 2018

(86) PCT No.: PCT/EP2018/061753
§ 371 (c)(1),
(2) Date: Nov. 8, 2019

(87) PCT Pub. No.: WO2018/206518
PCT Pub. Date: Nov. 15, 2018

(65) Prior Publication Data

US 2020/0165102 A1 May 28, 2020

(30) Foreign Application Priority Data

May 11, 2017 (DE) ..... 10 2017 110 256.6

(51) Int. Cl.
*B66B 5/22* (2006.01)
*B66B 1/32* (2006.01)

(52) U.S. Cl.
CPC . *B66B 5/22* (2013.01); *B66B 1/32* (2013.01)

(58) Field of Classification Search
CPC ..... B66B 1/32; B66B 5/18; B66B 5/22
See application file for complete search history.

(56) References Cited

U.S. PATENT DOCUMENTS 1,678,031 A * 7/1928 Anderson ..... B66B 5/04 187/376
4,083,432 A * 4/1978 Lusti ..... B66B 5/04 187/373

(Continued)

FOREIGN PATENT DOCUMENTS

CN 1648026 A 8/2005
CN 202785154 U 3/2013

(Continued)

OTHER PUBLICATIONS

1st Office Action, dated Aug. 18, 2020, in Chinese counterpart patent application No. 201880030577.3, citing the above identified references that were not previously listed in a prior IDS submitted to the USPTO for this pending US application.

(Continued)

*Primary Examiner* — Minh Truong
(74) *Attorney, Agent, or Firm* — William J. Cassin

(57) ABSTRACT

A safety device for an elevator system may include a safety element that in a release position holds a safety system in a deactivated state and in a blocking position activates the safety system. The safety element may exert a driving force configured to transfer the safety element from the release position into the blocking position. A holding element may exert a holding force on the safety element that counteracts the driving force to hold the safety element in the release position. In the release position of the safety element, the holding force exceeds the driving force by a tolerance amount that is adjustable depending on different operating modes that are possible in the release position of the safety element. The safety device may be configured to transfer the safety element into the blocking position, to reduce the holding force such that the driving force exceeds the holding force.

4 Claims, 3 Drawing Sheets

(56) References Cited

U.S. PATENT DOCUMENTS

| | | | | |
|---|---|---|---|---|
| 7,128,189 | B2 * | 10/2006 | Maury | B66B 5/04 187/373 |
| 8,631,909 | B2 * | 1/2014 | Draper | B66B 5/06 187/373 |
| 9,873,592 | B2 * | 1/2018 | Powers | B66B 5/044 |
| 2004/0112683 | A1 | 6/2004 | Christoph | |
| 2007/0272503 | A1 * | 11/2007 | Kigawa | B66B 5/18 187/379 |
| 2012/0152659 | A1 | 6/2012 | Josef | |
| 2015/0129365 | A1 * | 5/2015 | Olkkonen | F16D 65/0006 187/250 |
| 2017/0073191 | A1 | 3/2017 | Thumm et al. | |

FOREIGN PATENT DOCUMENTS

| | | | |
|---|---|---|---|
| CN | 205023647 | U | 2/2016 |
| DE | 10 2015 217 423 | A | 3/2017 |
| EP | 1400476 | A | 3/2004 |
| JP | H11106154 | A | 4/1999 |

OTHER PUBLICATIONS

English Translation of International Search Report issued in PCT/EP2018/061753, dated Jul. 25, 2018 (dated Aug. 6, 2018).

* cited by examiner

SAFETY DEVICE FOR A LIFT SYSTEM, LIFT SYSTEM AND METHOD FOR OPERATING A SAFETY DEVICE

CROSS REFERENCE TO RELATED APPLICATIONS

This application is a U.S. National Stage Entry of International Patent Application Serial Number PCT/EP2018/061753, filed May 8, 2018, which claims priority to German Patent Application No. DE 10 2017 110 256.6, filed May 11, 2017, the entire contents of both of which are incorporated herein by reference.

FIELD

The present disclosure generally relates to elevators, including elevator systems, safety devices for elevator systems, and methods of operating such safety devices.

BACKGROUND

Elevator systems typically comprise at least one safety device, in order to meet safety requirements. Safety devices are designed, for example, to prevent an uncontrolled movement of an elevator car, and in particular to prevent the elevator car from crashing down, in an emergency and/or in the event of a malfunction. Such a safety device is described, for example, in the post-published document DE 10 2015 217 423 A1.

Such safety devices are often spring-loaded and/or weight-loaded mechanical systems, wherein a driving force is designed to bring the safety device from a release position into a blocking position. Typically, the safety devices are held in the release position by a holding force, wherein in an emergency and/or in the event of a malfunction, in order to activate the safety device, the holding force is reduced or switched off in order to bring the safety device into the blocking position and thereby activate the safety device. An electromagnet is frequently used to provide the holding force, the magnetic force of which electromagnet is greater than the driving force and is at least partially opposed to the driving force in order to be able to hold the safety device in the release position. For example, an electromagnet with a power consumption of between 50 W and 500 W can be suitable for use within the scope of a holding element.

To that end, the electromagnet used is usually permanently energized in order to hold the safety device permanently in the release position and in order to ensure that the holding force is automatically reduced in the event of a power failure and the safety device is thereby automatically brought into the blocking position. Furthermore, the safety devices are typically so configured that the electromagnet is switched off and/or its magnetic force or holding force is reduced if a fault and/or an emergency is detected. Owing to the driving force of the safety device, the safety device is thus immediately activated as soon as the holding force of the electromagnet is reduced to below the driving force or is absent completely.

Unintentional activation of the safety device can in certain circumstances make it necessary to maintain the elevator system and/or to actuate an actuator provided specifically for that purpose, which frequently results in a downtime for the elevator system. In order to prevent unintentional activation of the safety device, the electromagnet must therefore usually be permanently energized, regardless of whether the elevator system is moving or not. In particular in the case of infrequently frequented elevator systems, the electric power consumed by the electromagnet can thus make up a large proportion of the total electric power consumed by the elevator system. For this reason, in particular in the case of infrequently frequented elevator systems, the operating costs of the elevator system are markedly increased by the safety device. Moreover, it is typically necessary to keep available a correspondingly large storage means for electrical energy, for example a battery, for an emergency, for example for emergency operation and/or evacuation of the elevator system.

Regular and/or planned switching off of the magnet is also frequently not provided because it leads to undesirable noise in the elevator system and/or because the mechanics of the safety device may not be designed for a plurality of cycles or activations and/or because, after activation of the safety device, an expensive maintenance and/or resetting procedure for the safety device is required.

In addition, the holding force, or the electromagnet, is typically dimensioned, or designed, to avoid unintentional activation of the safety device during operation of the elevator system, since this can result, for example, in considerable deceleration of the elevator car and/or trapped passengers and/or a reduction in the availability of the elevator system, and can also cause an increased outlay for restarting. In addition, the holding force must be such that account is also taken, by means of a tolerance amount, of other environmental influences which may reduce the effect of the holding force on the safety device, such as the presence of any dust between the magnet and an armature plate and/or an increased operating temperature, which can reduce the effective holding force of the magnet. The holding force must also be so dimensioned that accelerations and/or vibrations which occur in the elevator system during operation do not lead to unintentional activation of the safety device. For these reasons, the holding force to be provided for the safety device, which is provided, for example, by means of an electromagnet, is many times higher than the amount of the driving force of the safety device. Correspondingly, sufficient energization of the electromagnet is to be provided in order to provide the required holding force, whereby a considerable electrical energy requirement can arise.

Thus a need exists for a safety device for an elevator system that ensures safe operation of the elevator system and that consumes minimal energy.

DETAILED DESCRIPTION

Figure 1:
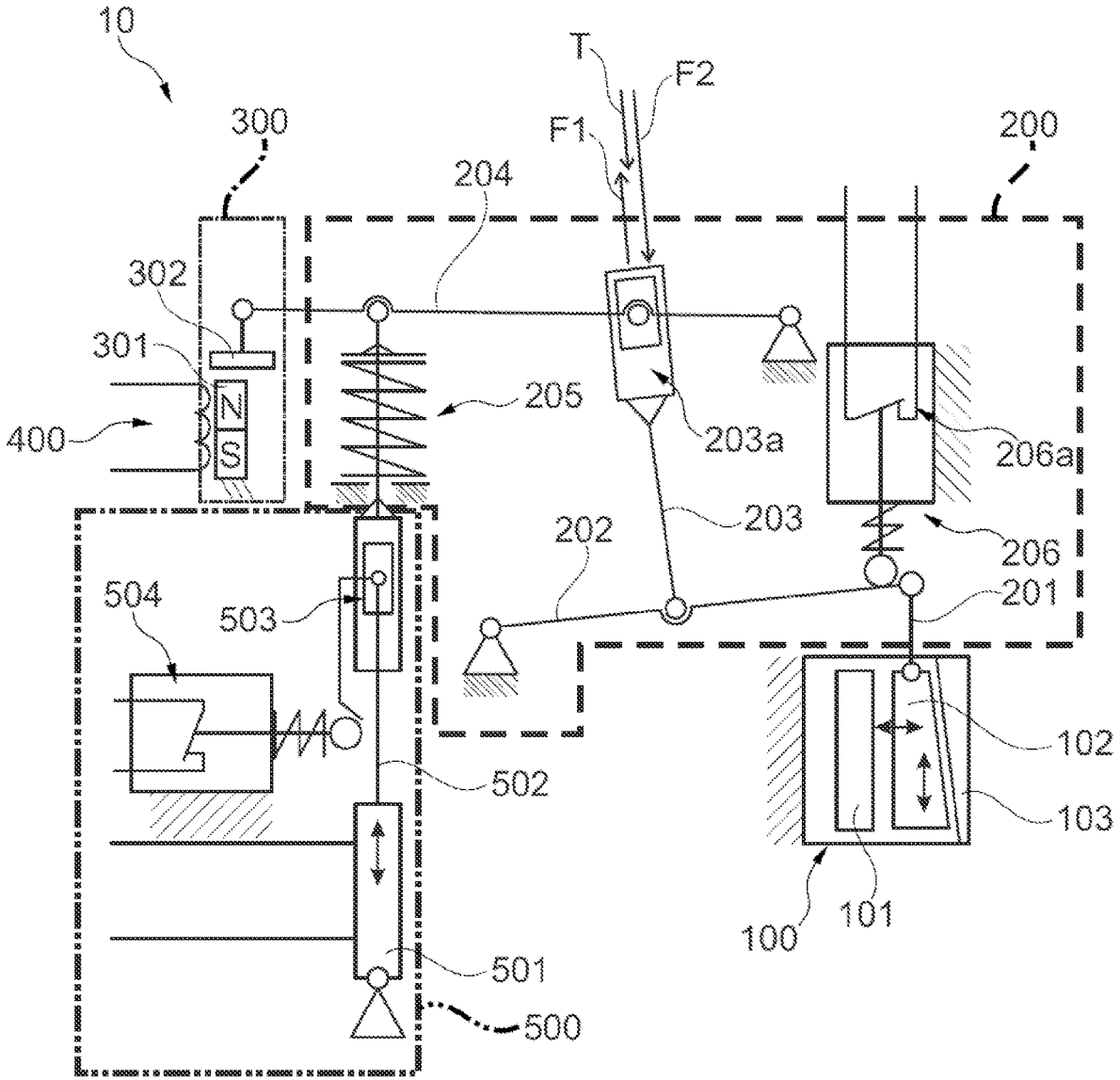
FIG. 1 is a schematic view of an example safety device for an elevator system in an unactivated state.

Although certain example methods and apparatus have been described herein, the scope of coverage of this patent is not limited thereto. On the contrary, this patent covers all methods, apparatus, and articles of manufacture fairly falling within the scope of the appended claims either literally or under the doctrine of equivalents. Moreover, those having ordinary skill in the art will understand that reciting "a"

element or "an" element in the appended claims does not restrict those claims to articles, apparatuses, systems, methods, or the like having only one of that element, even where other elements in the same claim or different claims are preceded by "at least one" or similar language. Similarly, it should be understood that the steps of any method claims need not necessarily be performed in the order in which they are recited, unless so required by the context of the claims. In addition, all references to one skilled in the art shall be understood to refer to one having ordinary skill in the art.

In one aspect, the invention relates in particular also or alternatively to a safety device for an elevator system having a safety element which in a release position holds a safety system in a deactivated state and in a blocking position activates the safety system, wherein the safety element exerts a driving force whose action is directed in such a manner as to transfer the safety element from the release position into the blocking position. The safety device further comprises a holding element which exerts a holding force on the safety element in such a manner that the holding force counteracts the driving force in order to hold the safety element in the release position. In the release position of the safety element, the holding force exceeds the driving force by a tolerance amount, wherein the tolerance amount is adjustable depending on different operating modes which are possible in the release position of the safety element. The safety device is further adapted, in order to transfer the safety element into the blocking position, to reduce the holding force in such a manner that the driving force exceeds the holding force.

In a further aspect, the invention relates to an elevator system having a safety device according to the invention.

In a further aspect, the invention relates to an elevator car of an elevator system having a safety device according to the invention.

In a further aspect, the invention relates to a method for operating an elevator system having a safety device according to the invention, comprising specifying the holding force of the at least one holding element during a first operating state, in particular a travel mode, of the elevator system in such a manner that the tolerance amount of the holding force assumes a first value greater than zero, and specifying the holding force of the at least one holding element during a second operating state, in particular at least in part during a rest mode, of the elevator system in such a manner that the tolerance amount of the holding force assumes a second value greater than zero which is smaller than the first value.

Exerting the holding force on the safety element is to be understood in particular as meaning the provision of a force and/or of a moment at a position of the safety device, in particular of the actuating mechanism. Thus, if a holding force is exerted that is equal to the driving force, that is to say if the tolerance amount is equal to zero, there is a force equilibrium between the holding force and the driving force. If the tolerance amount is greater than zero, the holding force exceeds the driving force by the tolerance amount. The holding force exerted on, or the holding force at a point of application of the holding force, therefore does not necessarily have to be equal to an amount of the holding force at a source of force.

The different operating modes are in particular different operating modes of the elevator system. The different operating modes preferably include a travel mode and/or a rest mode of the elevator system. In addition, further operating modes can preferably be designed, or provided.

The elevator system is preferably operated during the travel mode in such a manner that the at least one elevator car of the elevator system can be moved and in particular can stop at various stops of the elevator system. For example, the travel mode can also include stopping and/or waiting at one of the stops and/or away from the stops. For example, the travel mode can also allow the at least one elevator car to be loaded/unloaded and/or passengers to enter/leave, preferably in or at stops of the elevator system. In particular, the travel mode can constitute an operating mode in which the occurrence of fluctuations, oscillations and/or vibrations in the elevator system and/or the elevator car, in particular while the elevator car is moving, is to be expected and therefore a large tolerance amount can be advantageous for reliably preventing unintentional activation of the safety element.

The elevator system is preferably operated during the rest mode in such a manner that the at least one elevator car is in a rest position, or park position, for a prolonged period of time without movement of the at least one elevator car being easily possible during the prolonged period of time of the rest mode. For example, the at least one elevator car can be positioned, or parked, at a stop of the elevator system during the rest mode. In particular, it can be necessary during the rest mode, before the elevator car is moved, first to end the rest mode and to transfer the elevator system into a different operating mode, for example into the travel mode, before movement of the at least one elevator car is possible. In particular, the rest mode can constitute an operating mode in which the occurrence of fluctuations, oscillations and/or vibrations in the elevator system and/or the elevator car, in particular while the at least one elevator car is parked, is not to be expected and therefore a smaller tolerance amount can be sufficient for reliably preventing unintentional activation of the safety element.

The deactivated safety element preferably allows an elevator car of the elevator system to be moved in normal operation and the activated safety element at least partly prevents the elevator car of the elevator system from being moved. In other words, the safety element according to preferred embodiments can be adapted to limit or even completely prevent a movement, or movability, of an elevator car of the elevator system in in the active state.

In particular, the provision of a rest mode can be advantageous in the case of infrequently frequented elevator systems which, for example, are used only rarely. In this case, the elevator system and/or the safety device, for example, can be so adapted that, after a predetermined period of time in which the elevator system has not been used, the elevator system and/or the safety device is transferred into the rest mode. Alternatively or in addition, the elevator systems can be transferred into the travel mode during some time periods, so that the elevator system is ready to move the elevator cars, and during other time periods they can be transferred into the rest mode, so that the elevator system can remain in the parked state in an energy-saving manner. For example, the elevator system can be adapted to be transferred into the travel mode during predetermined or specified opening times of a building and/or to be transferred into the rest mode at least intermittently outside opening times. For example, the elevator system can also be adapted to be transferred into one of several operating modes by qualified operating personnel.

The tolerance amount is understood in particular as meaning the proportion of the holding force which exceeds the driving force in terms of amount. In this respect, the tolerance amount provides an assurance in case the driving force increases or the holding force falls for a short time during operation, for example as a result of vibrations. The invention offers the advantage that the tolerance amount can have different values. This makes it possible in particular to choose the tolerance amount for one operating mode of the elevator system to be sufficiently high that safe operation of the elevator system is made possible and in particular unintentional activation of the safety device is prevented. In particular, the tolerance amount can be so chosen that the holding force is sufficient to reliably prevent unintentional activation of the safety device, for example even on occurrence of disadvantageous influences, such as, for example, vibrations and/or increased ambient temperatures. To that end, the tolerance amount can be so chosen, for example, that the amount of the total holding force exceeds the amount of the driving force by a multiple. On the other hand, the invention allows the tolerance amount of the holding force to be adapted so that the tolerance amount can be reduced when the elevator system is in a rest mode and/or is not in operation. In other words, the invention allows the holding force to be lowered in particular when the elevator system has specifically not been transferred into the travel mode but is, for example, in a rest position or in a rest mode. The safety element preferably comprises a weight-loaded mechanical system and/or a spring-loaded mechanical system, or is in the form of such a system. For example, the safety device can be in the form of an arresting device or can comprise such a device. Furthermore, the safety device can preferably be arranged in and/or on an elevator car of the elevator system and/or arranged in and/or on a shaft of the elevator system.

The inventors have recognized that a reduction of the holding force, or the tolerance amount of the holding force, is advantageous when the elevator system is not in operation and/or is in the rest mode, because major decelerations and/or accelerations and/or vibrations in the elevator system are not to be expected when the elevator system is not in operation and therefore a lower tolerance amount of the holding force can be sufficient for reliably preventing unintentional activation of the safety device.

Should the safety device nevertheless be unintentionally activated when the elevator system is not in operation or during the rest mode of the elevator system, for example because the tolerance amount was lowered too far and/or unexpectedly great influences, such as vibrations and/or temperatures, act on the safety device and thereby support the driving force at least for a short time, the consequences of the unintentional activation of the safety system can be acceptable because, for example, it is not possible for passengers to be trapped when the elevator car(s) of the elevator system is/are at a stop as long as the elevator system is not in operation and/or is in the rest mode.

Accordingly, the invention makes it possible for the holding force, or the tolerance amount of the holding force, to be adapted according to the situation, in order to keep the holding force as low as possible but nevertheless ensure appropriate protection against unintentional activation of the safety device. This therefore makes it possible, for example, for an energy consumption of the holding element to be reduced at least at times in which the elevator system is not in operation and/or is in the rest mode, but nevertheless for protection against unintentional activation of the safety device to be provided in accordance with the desired requirements when a greater tolerance amount is required, that is to say, for example, during a travel mode of the elevator system. It is accordingly possible not only to reduce the energy consumption of the elevator system, in particular when the elevator system is not in operation or is in the rest mode, but also to increase the durability, or service life, of the holding element, because it is exposed to lesser loads at least at times in which the elevator system is not in operation or is in the rest mode.

The invention therefore offers an advantage in particular for seldom frequented elevator systems, in which the energy consumption during times in which the elevator system is not in operation or is in the rest mode typically constitutes a large proportion of the overall energy consumption.

The holding element can preferably be varied and/or influenced in such a manner that the tolerance amount of the holding force is variable. For example, this can be achieved by providing a holding element whose holding force, or whose tolerance amount of the holding force, can be adjusted. This offers the advantage that the holding force of the holding element, or the tolerance amount of the holding force, which exceeds the amount of the driving force, can be adapted to the needs or requirements of the elevator system in question. A holding element can particularly preferably be in such a form that the holding force, or the tolerance amount of the holding force, can be continuously varied in a predetermined value range. This offers the advantage that the safety device has a high degree of flexibility and can be adapted in a simple manner to the requirements of the elevator system.

The safety device is preferably so adapted that the tolerance amount of the holding force can be varied by means of a power supply of the holding element. For example, by varying the energy or power supplied to the holding element, or to the safety device, the holding force of the holding element, or the tolerance amount of the holding force, can be varied. This offers the advantage that a particularly simple adjustment possibility of the holding force, or of the tolerance amount, can be achieved, wherein the adjustment possibilities preferably do not require any mechanical change to and/or any mechanical action on the safety device and/or the holding element.

The safety device preferably comprises a plurality of holding elements which are adapted to jointly exert the holding force on the safety element, wherein the safety device is adapted to vary the tolerance amount of the holding force by activating and/or deactivating some of the plurality of holding elements. For example, the safety device comprises a plurality of holding elements which can correspondingly be connected and/or disconnected as required. If, for example, only a small tolerance amount, or a small holding force, is required, such as when the elevator system is not in operation or is in the rest mode, it can be sufficient, for example, if only some of the plurality of holding elements are active, for providing the holding force, while other holding elements of the plurality of holding elements are deactivated and/or do not contribute to providing the holding force. If, however, a high tolerance amount, or a high holding force, is required, for example for the travel mode of the elevator system, one or more holding elements can preferably be connected in, so that the holding force is provided by a larger number of holding elements than during a period of time in which the elevator system is not in operation or is in the rest mode. A particularly flexible variability of the safety device, or of the holding element, or of the holding force, is thereby achieved. The holding elements of the plurality of holding elements can in each case be of the same type or of different types and in particular can be designed to provide equal or different components of the holding force.

The safety device preferably comprises at least two holding elements which are adapted to exert different holding forces, and wherein the safety device is adapted, for adjusting a larger tolerance amount, to activate a first holding element of the at least two holding elements which exerts the greater holding force of the at least two holding elements and, for adjusting a smaller tolerance amount, to activate a second holding element of the at least two holding elements which exerts the smaller holding force of the at least two holding elements.

The tolerance amount is at least 5%, preferably at least 10%, further preferably at least 15%, yet further preferably at least 20%, more preferably at least 30%, much more preferably at least 40%, most preferably at least 50%, of an amount of the driving force. Furthermore, the tolerance amount is preferably not more than fifteen times, preferably not more than ten times, further preferably not more than eight times, yet further preferably not more than four times, as great as the amount of the driving force. Unintentional or undesired activation of the safety device can thereby reliably be prevented and a reduction in the power requirement can nevertheless be achieved.

The holding element preferably comprises at least one electromagnet, wherein the at least one electromagnet is particularly preferably adapted to provide the holding force by means of a magnetic force. This offers the advantage that the magnetic force, or holding force, provided by the electromagnet can be varied and/or adjusted in a simple manner by, for example, varying the current supplied to the at least one electromagnet. A higher current can provide a higher magnetic force and correspondingly a higher holding force, while a lower current flow can be required for a lower holding force. Advantages in terms of the energy consumption can also be obtained in that an operating voltage of the at least one electromagnet is varied and in particular is reduced when the elevator system is not in operation or is in the rest mode. In particular, the magnetic force, or holding force, can be non-linearly dependent on the operating voltage, so that, for example, a reduction in the required holding force makes possible a disproportionately larger reduction in the operating voltage and thus a disproportionately greater saving of electrical energy. For example, the reduction in the operating voltage can accompany the reduction in the holding force quadratically. For example, a reduction in the tolerance amount, or holding force, by 50% can permit a reduction in the operating voltage of the at least one electromagnet by 75%. A reduction in the electrical voltage and thus a reduction in the consumption of electrical energy and/or electric current and thus a reduction in the tolerance amount of the holding force can preferably be achieved by means of a transformer and/or a pulse width modulation of the electrical voltage.

According to a preferred embodiment, the holding element, or the safety device, comprises at least two electromagnets of different strengths, between which it is possible to switch according to the required holding force. For example, during the travel mode, the stronger of the at least two electromagnets can be activated in order to provide a holding force with a larger tolerance amount. On the other hand, when the elevator system is not in operation or is in the rest mode, the weaker of the at least two electromagnets can be activated, while the stronger of the two electromagnets is deactivated, in order to provide a holding force with a smaller tolerance amount. Alternatively, at least two identical or different electromagnets can be provided, wherein, for example, when the elevator system is not in operation or is in the rest mode, only one electromagnet provides the holding force, whereas during the travel mode at least two electromagnets provide the holding force.

According to some preferred embodiments it is also possible, for varying the holding force, to provide a pre-resistor which makes it possible to vary a consumption of electric current and/or electric power by the at least one electromagnet and thus vary the magnetic force, or holding force, caused by the at least one electromagnet.

According to a further preferred embodiment, the at least one holding element can comprise a permanent magnet and an electromagnet, wherein the holding force provided, or exerted, by the permanent magnet is smaller than the driving force and the driving force provided holding force provided, or exerted, by the electromagnet is smaller than the driving force, wherein the sum of the holding force of the permanent magnet and the holding force of the electromagnet is greater than the driving force. In other words, the permanent magnet and the electromagnet are so configured that a total holding force, or holding force, that is sufficient to hold the safety element in the release position can be provided only by both magnets together. This offers the advantage that the electromagnet can be provided with a lower power, or a lower holding force, than when an electromagnet alone has to provide the entire holding force, or the total holding force. The energy consumption of the holding element can thereby be reduced.

The safety element preferably comprises articulated stops which are adapted to limit a range of travel of an elevator car of the elevator system. The articulated stops can, for example, be held in the release position by the holding element and/or brought into a blocking position by a driving force.

Alternatively or in addition, the safety element can preferably comprise, for example, a telescopic apron at a door of the elevator car, which telescopic apron is preferably adapted to prevent passengers from falling into a region beneath the elevator car in the blocked position.

Alternatively or in addition, the safety element can preferably comprise, for example, an additional brake which is adapted to brake a movement of the elevator car.

Alternatively or in addition, the safety element can preferably comprise, for example, one or more rotatable buffers which, for example, limit a range of travel of at least one elevator car in the blocking position and in the release position release, that is to say do not limit, the range of travel.

Alternatively or in addition, the safety element can preferably comprise, for example, a rotatable rail which is adapted, for example, to prevent passengers from falling in the blocked position.

Alternatively or in addition, the safety element can preferably comprise, for example, an adjustable ventilation opening which can be brought into different operating positions by the holding element and/or by the driving force.

Alternatively or in addition, the safety element can preferably comprise, for example, an access control to an emergency escape route in order, for example, in the event of danger to free access to the emergency rescue path for the passengers.

Alternatively or in addition, the safety element can preferably be in the form of, for example, an arresting device (10) or can comprise such a device. This can offer the advantage that, in the event of danger, an uncontrolled downward movement of at least one elevator car can be avoided when the arresting device is transferred into the blocking position.

Further advantages and embodiments of the invention will become apparent from the description and the accompanying drawings.

It will be appreciated that the features mentioned above and those still to be mentioned hereinbelow can be used not only in the combination given in a particular case but also in different combinations or in isolation, without departing from the scope of the present invention.

Figure 2:
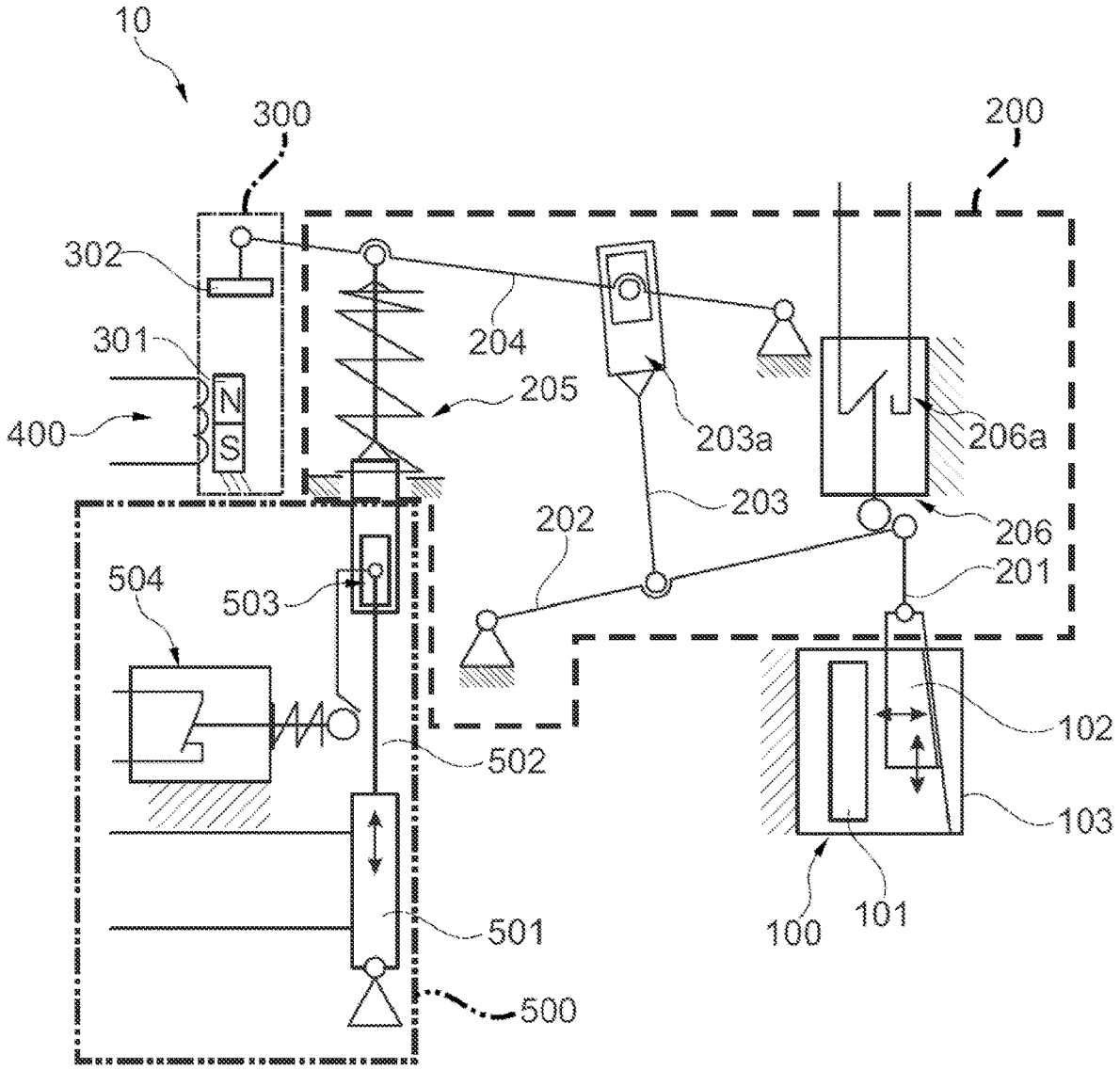
FIG. 2 is a schematic view of the safety device of FIG. 1 in an activated state.

FIGS. 1 and 2 are described together and each shows schematically a preferred embodiment of a safety device 10 according to the invention for an elevator system. The safety device 10 is in the form of an arresting device 10. The arresting device 10 is fastened, for example, to an elevator car of an elevator system, the movement of which elevator car is to be braked in an emergency and/or in the event of a fault.

The arresting device 10 comprises a safety element 100 which in the embodiment shown is in the form of a wedge brake 100 which, in the actuated state, is capable of braking a movement of an elevator car (not shown) of the elevator system. To that end, the wedge brake 100 comprises a fixed brake shoe 101 and a wedge-shaped brake shoe 102 which is movable vertically and horizontally (indicated in each case by double-headed arrows) in the figure and which is supported on a slanting plane 103. A guide rail (not shown) of the elevator system, for example, can extend in a gap between the brake shoes 101 and 102, which guide rail can be clamped by closing the wedge brake 100.

The wedge brake 100, more precisely the movable brake shoe 102 thereof, is connected to a ram 201 of an actuating mechanism 200. The actuating mechanism 200 is adapted to assume a first and a second position, wherein the actuating mechanism 200 in the first position, shown in FIG. 1, the release position, leaves the wedge brake 100 unactuated and in the second position, shown in FIG. 2, the blocking position, actuates the wedge brake 100.

The actuating mechanism 200 comprises a linkage 202, 203, 204 which comprises a first lever, which here acts as an actuating lever 202, and a second lever, which here acts as a restoring lever 204, which levers are coupled together via a coupling rod 203.

The actuating lever 202 is pivotably mounted at a first end (the left-hand end in FIG. 1) and is connected at a second, in particular displaceable end (the right-hand end in the figure) to the ram 201. At a connection point located between the two ends, the actuating lever 202 is connected to the coupling rod 203.

The restoring lever 204 is pivotably mounted at its right-hand end in the figure, and pressure or force from a pressure reservoir, which here is in the form of a compression spring 205, is applied in the region of its movable end. The pressure reservoir 205 is designed to provide the driving force F1 of the safety element 100. The restoring lever 204 is likewise connected to the coupling rod 203 at a connection point.

The coupling rod 203 comprises a freewheel 203*a* which allows the actuating mechanism 200 to be restored from the second position into the first position without at the same time restoring the wedge brake 100 from the activated, actuated position into the deactivated, unactuated position.

In other words, the tensioning, or restoring, described in greater detail hereinbelow, of the actuating mechanism 200 in the activated case of the arresting device does not automatically also lead to the release (transfer from the activated position into the deactivated position) of the wedge brake; instead, it is provided for safety reasons that the wedge brake 100 must be released separately, for example manually.

In the embodiment shown, the actuating mechanism 200 additionally comprises an arresting mechanism monitoring means 206. The monitoring means 206 monitors whether the wedge brake 100 is in the actuated (activated) or unactuated (deactivated) position. In the representation shown, the arresting mechanism monitoring device 206 comprises a switch 206*a* which is closed when the wedge brake is open (deactivated) (see FIG. 1) and which is open when the wedge brake is closed (activated) (see FIG. 2).

The arresting device 10 further comprises a holding element 300, which in the example shown is coupled to the restoring lever 204. The holding element can, however, without loss of generality, also be coupled to the actuating lever 202.

The holding element 300 is configured to hold the actuating mechanism 200 in the first, release position shown in FIG. 1 using a permanent magnet 301, which magnetically attracts an associated armature 302. The permanent magnet 301 and the armature 302 are, however, so configured that the holding force generated by those components alone is not able to hold the safety device in its release position.

The arresting device 10, or the holding element 300, further comprises an electromagnet 400 which is adapted, together with the permanent magnet, to hold the compression spring 205 in the first, release position shown in FIG. 1. For this purpose, a magnetic field is generated by the electromagnet 400 which ultimately generates a holding force which counteracts the driving force F1 exerted by the compression spring 205. Together with the holding force effected by the permanent magnet 301, a total holding force F2 is exerted which is greater than the driving force F1 exerted by the compression spring. The transfer of the safety device into the blocking position is initiated by switching off or reducing the power of the electromagnet 400.

The driving force F1, the holding force F2 and the tolerance amount T are illustrated by way of example in FIG. 1 by the corresponding arrows. It can thereby be seen that the amount of the holding force F2 at the component on which the forces act exceeds the amount of the driving force F1 by the tolerance amount according to the embodiment shown. For example, the tolerance amount T can be so chosen that, in the rest mode of the elevator system, the holding force F2 exceeds the driving force only slightly, whereas during a travel mode of the elevator system, the tolerance amount T can be so chosen that the holding force F2 exceeds the driving force T by a larger amount.

The forces acting on the component in question, or on the holding element, are always to be compared. That is to say, the forces are in equilibrium when the amount of the driving force F1 is equal to the amount of the holding force F2. These amounts can, however, in certain circumstances differ from the amounts of the respective forces at the force sources, for example because lever moments lead to a transmission and/or force transformation.

According to the preferred embodiment shown, the holding element 300 comprises only one electromagnet 400, wherein other embodiments can comprise a larger number of electromagnets. The electromagnet 400, or the holding element 300, are thereby so adapted that the magnetic field of the electromagnet 400, or the holding force, is variable so that a tolerance amount T by which the holding force F2 of the holding element 300 exceeds the driving force F1 of the compression spring 205 can variably be adjusted or adapted. This has the result that, during the travel mode of the elevator system, a large tolerance amount T, or a large holding force F2, can be provided, in order reliably to prevent unintentional activation of the safety device even if vibrations and/or fluctuations and/or shocks occur in the elevator system. For example, the safety device can be so adapted that the holding force F2 during the travel mode of the elevator system is approximately four times as great as the driving force F1, or compressive force, of the compression spring 205. By contrast, owing to the variability of the holding element 300, the holding force F2, or the tolerance amount T, can be reduced when the elevator system is not in operation or is in the rest mode, so that the holding force F2, for example, is only twice as great as the amount of the driving force F1 of the compression spring 205. As a result, the strength of the magnetic field to be provided by the electromagnet 400 is reduced, whereby the consumption of electric power or energy by the electromagnet 400 can also be reduced. Therefore, by adapting the holding force F2, or the tolerance amount T of the holding force F2, a significant amount of electric power or energy can be saved when the elevator system is not in operation or is in the rest mode.

Finally, the arresting device 10 comprises a restoring mechanism 500 which is adapted to restore the actuating mechanism 200 from the second, blocking position shown in FIG. 2 to the first, release position shown in FIG. 1. Alternatively or in addition, the restoring mechanism 500, without loss of generality, can also be adapted to restore the wedge brake 100 from the actuated (activated) position to the unactuated (deactivated) position.

To that end, the restoring mechanism 500 comprises a spindle drive 501, in which a spindle 502 can be moved by means of an electric motor (direction indicated by the double-headed arrow shown in the spindle drive 501). The spindle 501 is connected via a further freewheel 503 to the restoring lever 204 of the actuating mechanism 200. In the figure, this connection coincides with the connection of the compression spring 205, which is to be seen, however, purely by way of example.

The freewheel 503 may be configured for example (similarly to the freewheel 203) as a pin that can move in a slot. The freewheel 503 serves the purpose of making possible a movement of the wedge brake 100 from the unactuated position, shown in FIG. 1, into the actuated into the actuated position, shown in FIG. 2, without moving the restoring mechanism or the electric motor thereof. This ensures that the actuation of the wedge brake must take place substantially without any forces and in particular not against a holding force of the restoring mechanism or the electric motor thereof.

The return mechanism 500 is further equipped with a restoring mechanism monitoring means 504 which monitors whether a movement of the wedge brake 100 from the unactuated (deactivated) position into the actuated (activated) position is possible without moving the restoring mechanism 500, or the electric motor 501 thereof. In the example shown, an electric switch of the monitoring means 504 is closed when the freewheel 503 permits a movement of the restoring lever 204 and thus, via the coupling rod 203, the actuating lever 202 and the ram 201, also of the brake shoe 102 without at the same time moving the actuating mechanism 500 or the electric motor 501 thereof. If, on the other hand, the freewheel 503 does not permit such a movement without at the same time moving the actuating mechanism 500 or the electric motor 501 thereof (because the spindle 502 is retracted), the switch of the restoring mechanism monitoring means 504 is open.

The monitoring means 206 and 504 serve to increase the safety in that, when each of the switches is closed, which the application of a closed current principle permits, an operability or activatability of the arresting device is indicated.

An arresting device according to the invention can be operated in a highly energy-saving manner, since the holding device is so configured that it holds the actuating mechanism in a particularly energy-saving manner. In particular, the variability of the holding element 300, or of the electromagnet 400, offers a possibility to save electrical energy since, by reducing the holding force when the elevator system is not in operation, it is possible, for example, to reduce the electrical voltage supplied to the electromagnet 400.

Figure 3:
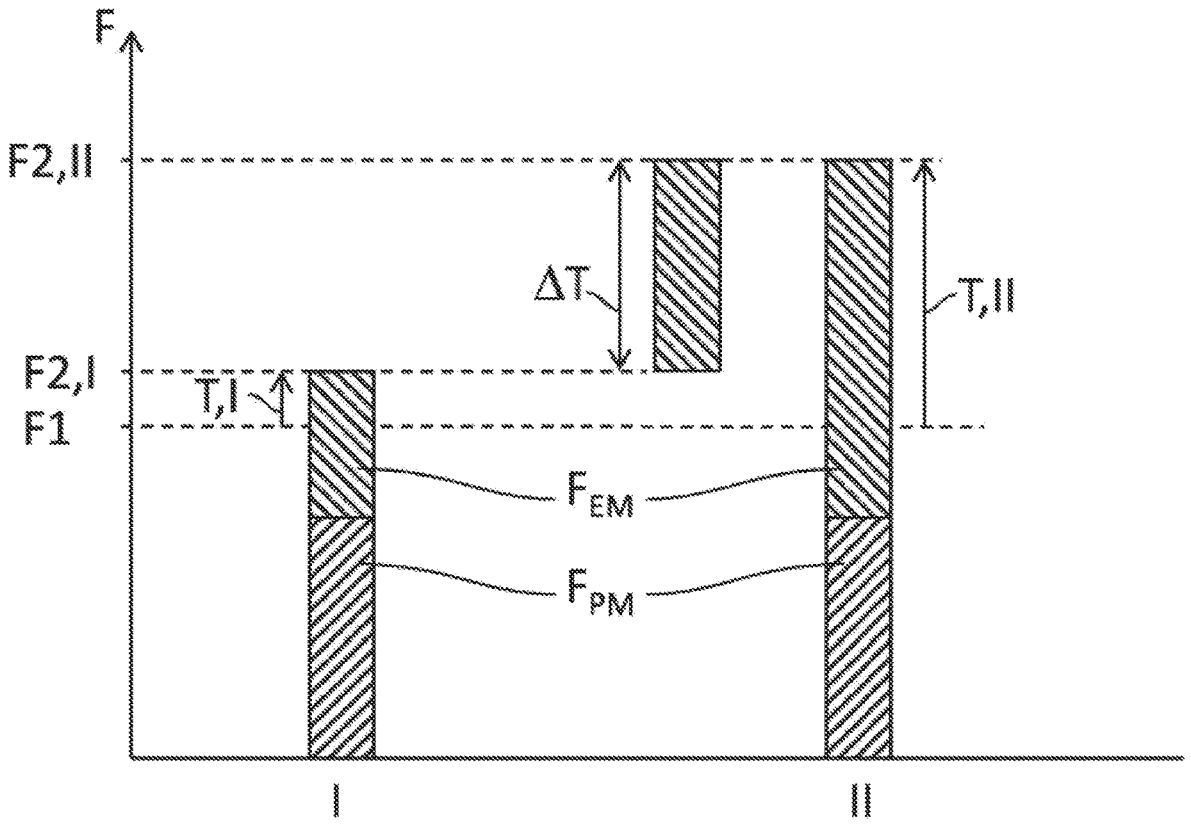
FIG. 3 is a diagram illustrating a comparison of forces to be applied by an example safety device for a first operating mode I and a second operating mode II of an elevator system.

FIG. 3 shows, in a diagram, a comparison of the forces to be applied by a safety device for a first operating mode I and a second operating mode II of an elevator system. For example, operating mode I can be a rest state of the elevator system, while operating mode II can be present during a travel mode of the elevator system.

The vertical axis F indicates the force at its respective point of application. F1 indicates the driving force of the safety element. In order to hold the safety element in the release position, a holding force F2 which counteracts the driving force F1 must act at the point of application, the amplitude of which holding force is at least equal to the driving force F1. In operating mode I, the corresponding holding force F2,I exceeds the driving force F1 by only a small tolerance amount T,I which is sufficient, however, to hold the actuating mechanism in the release position, or to keep the safety element deactivated, as long as no significant force influences occur on the safety element and/or on the holding element 300. The small tolerance amount T,I can thus be sufficient in particular for a rest mode or a rest position of the elevator system.

Both in operating mode I and in operating mode II, the holding force F2,I or F2,II is provided in part by a permanent magnet (proportion $F_{PM}$) and in part by an electromagnet (proportion $F_{EM}$). While the proportion of the holding force provided by the permanent magnet $F_{PM}$ is constant or unchangeable, the proportion of the holding force provided by the electromagnet $F_{EM}$ is variable and can therefore be increased and/or reduced.

In operating mode II, on the other hand, the holding force F2,II exceeds the driving force F1 by a very much larger tolerance amount T,II than T,I, so that the holding force F2,II at the point of application is significantly greater than the driving force F1. This offers the advantage that secure holding of the actuating element in the release position, or of the safety element in the deactivated position, is ensured even in the case of considerable external force influences on the safety element and/or on the holding element. Such a large tolerance amount T,II is thus advantageous in particular for an operation of the elevator system in which, for example, vibrations and/or shocks are to be expected.

In operating mode I, on the other hand, the proportion $F_{EM}$ of the holding force can be reduced as compared with operating mode II by means of the electromagnet. The difference ΔT between the two tolerance amounts T,I and T,II represents the saving in holding force which can be achieved if, on changing to a different operating mode in which a large tolerance amount is not required, the tolerance amount of the holding force is lowered from T,II to T,I. This offers the advantageous effect that the energy consumption and thus the operating costs can be lowered.

LIST OF REFERENCE NUMERALS

10 arresting device/safety device
100 wedge brake/safety element
101 fixed brake shoe
102 wedge-shaped brake shoe
103 slanting plane
200 actuating mechanism

201 ram
202 actuating lever
203 coupling rod
203*a* freewheel
204 restoring lever
205 compression spring/pressure reservoir
206 arresting mechanism monitoring means
206*a* switch/monitoring means
300 holding element
301 permanent magnet
302 armature
400 electromagnet
500 restoring mechanism
501 spindle drive
502 spindle
503 freewheel
504 restoring mechanism monitoring means
F1 driving force
F2 holding force
T tolerance amount

What is claimed is:

1. A method for operating an elevator system having a safety device, which safety device includes, a safety element, an actuating mechanism configured to be positioned in either of a release position that places the safety element in a deactivated state, or in a blocking position that activates the safety element, wherein the actuating mechanism exerts a driving force configured to activate the safety element, and a holding element configured to exert on the actuating mechanism a holding force that counteracts the driving force and holds at least one of the actuating mechanism in the release position, or the safety element in the deactivated state, wherein in the release position the holding force exceeds the driving force by a tolerance amount that is adjustable depending on an operating mode in the release position of the safety element, and wherein the holding element is further configured to trigger movement of the actuating mechanism from the release position to the blocking position, by reducing the holding force below an amount required to prevent the driving force from moving the actuating mechanism to the blocking position, the method comprising:

specifying the holding force of the holding element during a first operating state of the elevator system such that the tolerance amount of the holding force assumes a first value that is greater than zero; and specifying the holding force of the holding element during a second operating state of the elevator system such that the tolerance amount of the holding force assumes a second value that is greater than zero and is smaller than the first value.

2. The method of claim 1, further comprising:

positioning the actuating mechanism in the release position to place the safety element in the deactivated state;

activating the holding element to exert the holding force on the actuating mechanism and hold the actuating mechanism in the release position; and triggering the actuating mechanism to move from the release position to the blocking position by reducing the holding force below an amount required to prevent the driving force from moving the actuating mechanism to the blocking position; and activating the safety element by the movement of the actuating mechanism from the release position to the blocking position.

3. The method of claim 2, further comprising:

moving an elevator car freely in a normal operating condition while the holding element is activated to hold the actuating mechanism in the release position and the safety element in the deactivated state.

4. The method of claim 3, wherein said activating of the safety element at least partially prevents the elevator car from moving.

* * * * *